United States Patent [19]

Woodward

[11] 4,362,912

[45] Dec. 7, 1982

[54] SLIDER TYPE PUSH BUTTON SWITCH WITH SAFETY LOCKOUT FEATURE

[75] Inventor: Stewart A. Woodward, Morrison, Ill.

[73] Assignee: General Electric Company, Fort Wayne, Ind.

[21] Appl. No.: 243,859

[22] Filed: Mar. 16, 1981

[51] Int. Cl.[3] ..... H01H 9/26

[52] U.S. Cl. ..... 200/5 B; 200/5 E

[58] Field of Search ..... 200/5 R, 5 A, 5 B, 5 C, 200/5 D, 5 E, 5 EA, 5 EB, 5 F, 156, 159 R, 161, 50 C

[56] References Cited

U.S. PATENT DOCUMENTS

| | | | |
|---|---|---|---|
| 2,228,167 | 1/1941 | Kimball | 200/5 E |
| 2,431,904 | 12/1947 | Andrews | 200/5 EB |
| 2,878,329 | 3/1959 | Vermeulen | 200/5 EB |
| 3,384,721 | 5/1968 | Gartland, Jr. | 200/5 EB |
| 3,675,504 | 7/1972 | Schuh | 200/5 E |

OTHER PUBLICATIONS

G. E. Drawing 125B5162, Appl. Cont. Prod., Morrison, Ill., L. Larson, Feb. 15, 1973.

G. E. Drawing 125B5161, Appl. Cont. Prod., Morrison, Ill., L. Larson, Feb. 15, 1973.

*Primary Examiner*—A. T. Grimley

*Assistant Examiner*—Morris Ginsburg

*Attorney, Agent, or Firm*—Joseph E. Papin

[57] ABSTRACT

An electrical switch adapted to control a plurality of circuits therethrough has a plurality of push buttons reciprocally movable to effect the control of the circuits and including an "off" push button operable generally upon the depression thereof to open all of the circuits. Means is responsive to the depression of the "off" push button for precluding depression of certain of the other of the push buttons, and means actuated by an operator for rendering ineffective the precluding means includes one of the "off" push button and another of the push buttons.

16 Claims, 8 Drawing Figures

SLIDER TYPE PUSH BUTTON SWITCH WITH SAFETY LOCKOUT FEATURE

FIELD OF THE INVENTION

This invention relates in general to electrical switches and in particular to multiple push button switches having a lock out provision.

BACKGROUND OF THE INVENTION

In the past various types of electrical switches, such as multiple push button switches for instance, have been employed in conjunction with a wide variety of electrical equipment. For example, multiple push button switches have been frequently employed in household appliances, such as for instance blenders, food processors, electric ranges, washing machines, and air conditioners or the like, and such push button switches were operable to effect the selection of one of a variety of possible operating modes of such appliances. Frequently, such a multiple push button switch will have one push button corresponding to each possible mode of the appliance, including its "off" mode, and will be mechanically arranged so that only one push button may be actuated or depressed at any given time to select the desired operating mode of the appliance.

One prior art multiple push button switch of the type discussed above is illustrated in the Andrews U.S. Pat. No. 2,431,904. This patented push button switch discloses a plurality of adjacent laterally movable sliders within a switch housing with such sliders having numerous inclined or working surfaces adapted to be engaged by several push buttons of the switch. Depression of a respective one of these buttons is effective to move one or several of the sliders to a position determined by the particular working surface engaged by the depressed push button. The sliders also include cam surfaces which selectively engage contact supporting springs or switch blades with a particular combination of such cam surfaces determining the blade positions. Thus, a cam surface may engage a switch blade to prevent electrical connection between a contact supported on that blade and a fixed contact within the switch housing when the particular slider is in one position while allowing or forcing the fixed and blade supported contacts together when the slider is moved to a different position.

A prior art variation of the above discussed type of push button switch is disclosed in the Vermeulen U.S. Pat. No. 2,878,329 which is incorporated herein by reference. In this patent, push buttons selectively engage inclined or working surfaces on a plurality of sliders, and those sliders, in turn, include cam surfaces for actuating switch blades. The possibility of flashover occurring during switching from one electrical interconnection to another is minimized by positioning certain of the working surfaces more remote from the slider engaging portion of the push buttons than others of the working surfaces so that a delay in switch contact operation is achieved. In other words, in Vermeulen, upon depression of a push button, certain sliders begin their movement prior to the commencement of movement of others of the sliders.

In the prior art switches of the type disclosed by the above discussed Andrews and Vermeulen patents, transition from any one switch operating mode directly to any other switch operating mode is simply achieved by depressing the push button corresponding to that next operating mode. The prior art is also believed to suggest switching devices with built-in conditions or interlocks so that specified switch action sequences between switch operating modes do not occur. It is believed that a very elementary example of this type switch might be a three-position rotary switch wherein it is not possible to go from one extreme switch position to the other extreme switch position without first passing through the middle switch position. Further, it is also believed that limitations on the sequence of multiple push button switch actuation may also be known. For example, an early appliance control switch illustrated in the Kimball U.S. Pat. No. 2,228,167 required depression of an "off" or release button of such switch to effect the switching thereof from any one appliance energizing switch position to another appliance energizing switch position. A further example outside the appliance control art is found in the Schuh U.S. Pat. No. 3,675,504 which disclosed a taximeter having a "vacant" key which had to be operated thereby to unlock the other keys for subsequent operation.

SUMMARY OF THE INVENTION

Among the several objects of the present invention may be noted the provision of an improved electrical switch having advantageous or desirable features differentiating from the above discussed prior art electrical switches, as well as others; the provision of such improved electrical switch which renders inadvertent energization of a device electrically associated therewith unlikely; the provision of such electrical switch having a lockout feature; the provision of such electrical switch of the type employing push buttons to laterally move sliders for controlling contact closures with a condition precedent feature for transitioning from "off" to certain of the contact closures for particular switch operating modes; the provision of such improved electrical switch having a lockout slider movable in response to the depression of an "off" push button to a position precluding depression of at least certain of the other push buttons thereof; the provision of such electrical switch requiring two separate motions by the user when transitioning from the "off" operating mode thereof to certain other operating modes thereof; and the provision of such improved electrical switch which is simplistic in design, easily assembled and economically manufactured. These as well as other objects and advantageous features of the present invention will be in part apparent and in part pointed out hereinafter.

In general, a multiple push button switch in one form of the invention is operable generally between a plurality of different circuit completing states and an "off" state. Means actuated by operating the switch to its "off" state is provided for preventing direct operation of the switch to certain of the circuit completing states, and means is operable to transition the switch from its "off" state to another state thereof from which operation of the switch to any of the certain circuit completing states may be effected.

Also in general and in one form of the invention, an electrical switch is adapted to control a plurality of circuits therethrough. The switch has a plurality of operator actuable push buttons reciprocally movable to effect the control of the circuits including an "off" push button operable generally upon the depression thereof to open all of the circuits. Means is responsive to the depression of the "off" button for precluding direct depression of certain of the other of the push buttons, and means actuable by an operator for rendering ineffective the means includes one of the "off" push button and another of the push buttons.

BRIEF DESCRIPTION OF THE DRAWINGS

Corresponding reference characters indicate corresponding parts throughout the several views of the drawing.

The exemplifications set out herein illustrate a preferred embodiment of the invention in one form thereof, and such exemplifications are not to be construed as limiting the scope of the disclosure or the scope of the invention in any manner.

DETAILED DESCRIPTION OF THE PREFERRED EMBODIMENT

Figure 4:
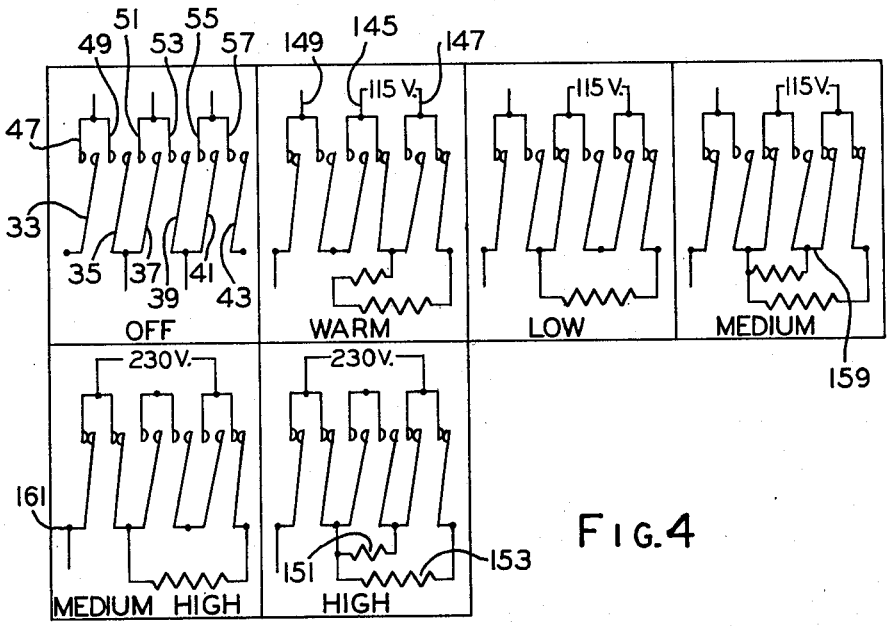
FIG. 4 illustrates in schematic form the electrical interconnections of an exemplary electric range "burner" in response to the depression of each push button of the electrical switch of FIG. 1.
Figure 5:
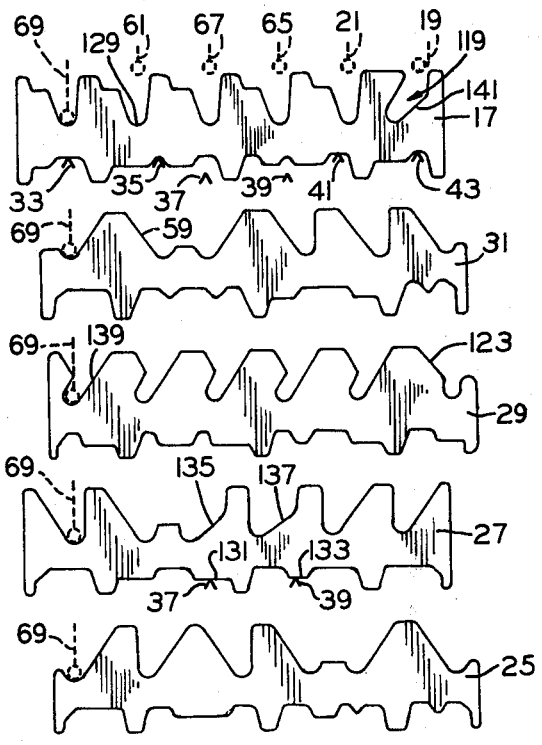
FIG. 5 is a schematic view showing the configuration of a set of sliders utilized in the switch of FIG. 1 and relatively positioned in the "high" position.
Figure 7:
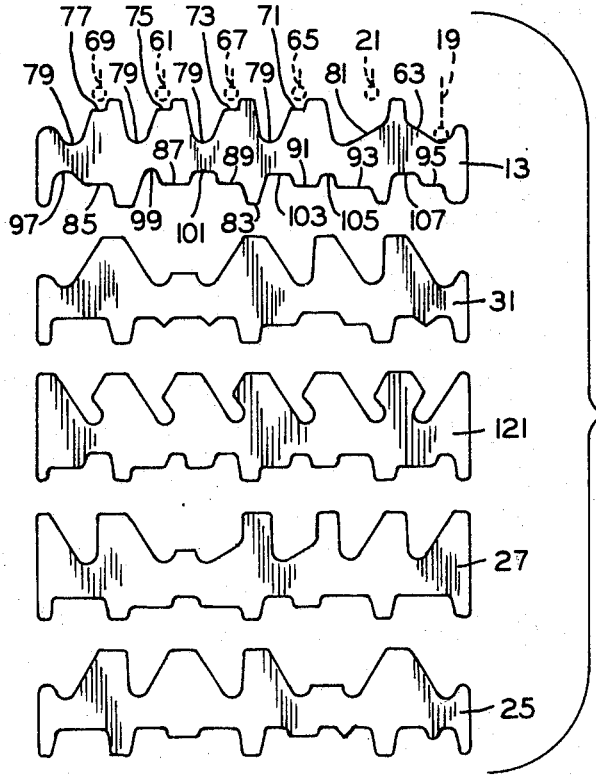
FIG. 7 is a schematic view showing the configuration of an alternate set of sliders which may be utilized in the switch of FIG. 1.
Figure 8:
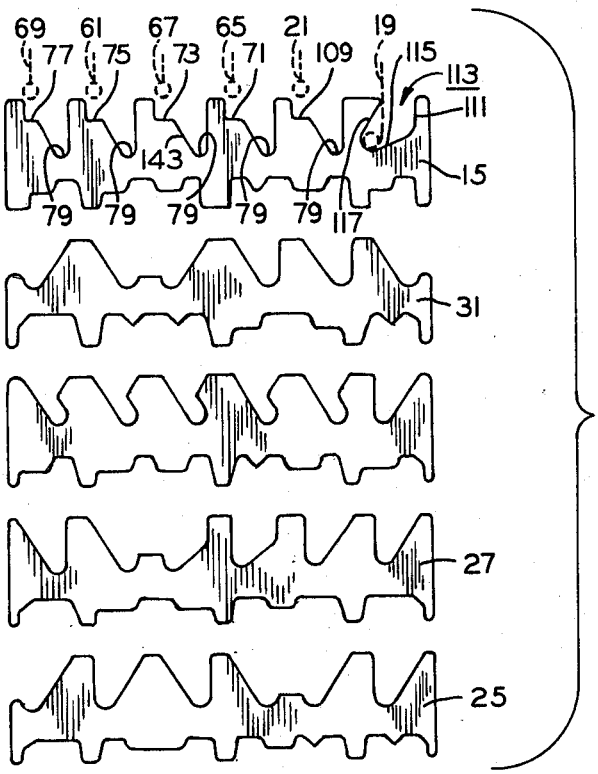
FIG. 8 is a schematic view showing the configuration of another alternate set of sliders which may also be utilized in the switch of FIG. 1.

Referring now to the drawings in detail, an electrical switch or a multiple push button switch 11 in one form of the invention is operable generally between a plurality of different switching or circuit completing states or modes as illustrated in FIG. 4, as well as an "off" state or mode with all of the switch circuits open. Means including a lockout slider, such as these illustrated at 13, 15 or 17 in FIGS. 5, 7 and 8, is actuated by operating the switch to its "off" state (depression of an "off" push button 19). With lockout sliders 13, 15 or 17 in their respective lockout positions positioned by operating switch 11 to its "off" state, direct operation to any of the five circuit completing states illustrated in FIG. 4 is prevented. Considering switch 11 utilizing lockout slider 13, this lockout slider prevents direct operation of switch 11 to any of its circuit completing states except for a "warm" state which may be directly actuated. To operate switch 11 to the locked out circuit completing states, it must first be transitioned from the "off" state to another or intermediate state by depressing a "warm" push button 21 in the case of lockout slider 13 or by withdrawing "off" push button 19 in the case of the utilization of lockout sliders 15 and 17 in switch 11, whereupon any of the circuit completing states may be then selected. Switch 11 is herein described solely for the purpose of explanation in the environment of an exemplary electric range burner control.

Figure 1:
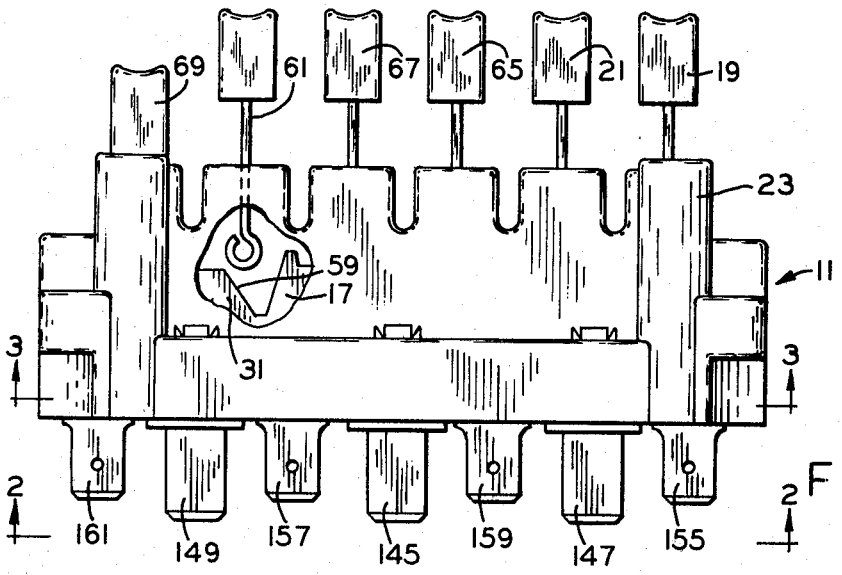
FIG. 1 is a front elevational view of an electrical switch in one form of the invention partly broken away to illustrate slider engagement by a push button of such electrical switch.
Figure 2:
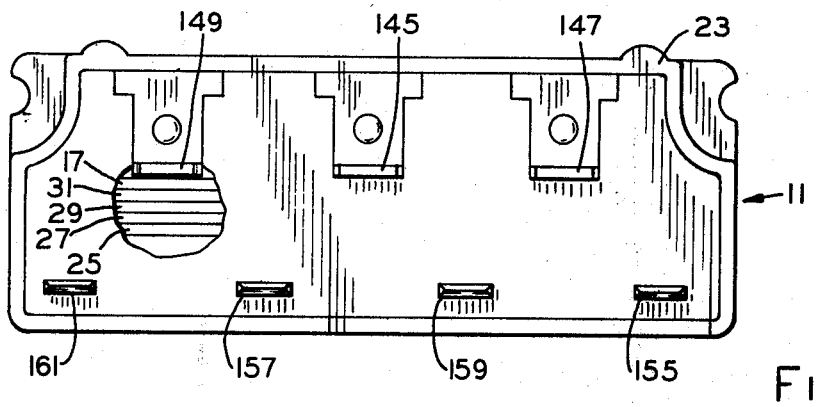
FIG. 2 is a bottom elevational view of the electrical switch of FIG. 1.
Figure 3:
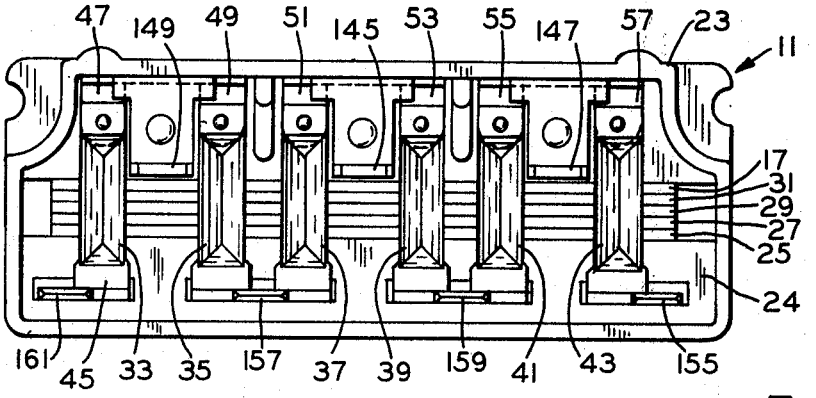
FIG. 3 is a sectional view taken along line 3—3 of FIG. 1.

More particularly and with specific reference to FIGS. 1 through 3, switch 11 includes a housing 23 having a chamber 24 with a plurality or set of elongate sliders 25, 27, 29, 31 and 17 assembled in the housing chamber generally in side-by-side relation for reciprocating movement to the left and right, as depicted in FIGS. 2 and 3. One lengthwise edge (that edge visible in FIGS. 2 and 3) of each slider is undercut to form cam surfaces for engaging and actuating a plurality of movable contact or switch blades 33, 35, 37, 39, 41 and 43. Each blade is fixed at one end, such as lower ends 45 as depicted, and is free to move at its opposite end to make and break contact with an opposing fixed contact 47, 49, 51, 53, 55 and 57. Each slider also has inclined surfaces, such as 59 in FIG. 1, which cooperate with the push buttons, such as illustrated at 61, which extend through a front or top wall of housing 23.

The inclined surfaces, such as 59 of slider 31, are arranged on the different sliders so that depression of any button will act on one or more of the sliders, causing them to shift the cam surfaces toward or away from some of the switch blades for changing the circuit arrangement of the switch. Thus, as illustrated in FIG. 1, depression of "medium high" push button 61 causes that push button to engage the inclined surface 59, moving slider 31 toward the left. As will appear more clearly in considering the actual slider inclined surfaces illustrated in FIGS. 5–8, a push button will typically engage the inclined surfaces of more than one slider and some of the inclined surfaces will extend in such directions that only one button may be fully depressed at any one time.

FIG. 7 illustrates a set of sliders for utilization in switch 11 in one form of the invention. Lockout slider 13 has an inclined surface 63 which is engaged by "off" push button 19 when that push button is depressed in response to an operator applied force exerted thereon to force lockout slider 13 toward one opposite or a left position thereof, as illustrated. In this left or lockout position of lockout slider 13, certain of the push buttons, such as push buttons 65, 67, 61 and 69, are respectively arranged at least adjacent a plurality of blocking or lockout surfaces 71, 73, 75 and 77 on the lockout slider for engagement therewith, which blocking surfaces extend generally in the direction of slider movement, and when lockout slider 13 is in its lockout position, such blocking surfaces preclude depression of the four certain push buttons in response to an applied force exerted thereon by an operator. Translation of lockout slider 13 toward another opposite or a right position thereof will of course juxtapose these four push buttons 61, 65, 67, 69 with undercut regions, such as 79, provided in the lockout slider so that the lockout slider no longer precludes the depression of the other push buttons 61, 65, 67, 69. With lockout slider 13 of FIG. 7, this unlocking is achieved by depressing "warm" push button 21 to engage an inclined surface 81, forcing the lockout slider toward its unlocking position, i.e., toward the right as viewed.

A lengthwise edge 83 of lockout slider 13 includes cam surfaces which, in the lockout position of the lockout slider, prevent closure of any of the switch circuits. Thus, when lockout slider 13 is in its lockout position, switch blade 33 is held open by the slider cam surface at 85, while switch blade 35 is held open by the slider cam surface at 87. The remaining switch blades engage the cam surfaces of slider 13 at 89, 91, 93 and 95, respectively. Translation of lockout slider 13 toward the right by depression of "warm" push button 21 presents to switch blade 33 an undercut region 97, and depending upon the positions of the other sliders, switch blade 33 may close on its corresponding fixed contact. The remaining switch blades are similarly juxtaposed with undercut cam portions 99, 101, 103, 105 and 107, respectively, freeing the switch circuits for selective closure depending upon the particular push button actuated. While lockout slider 13 is responsive to depression of "off" push button 19 to move to its lockout position, it is responsive to "warm" push button 21 for movement to the unlocked position thereof. A pulling or withdrawal movement of "off" push button 19 from its depressed position may be used to shift the lockout slider to its unlocked position, as illustrated by lockout slider 15 of FIG. 8.

In FIG. 8, depression of "off" push button 19 actuates lockout slider 15 toward the right as viewed to preclude direct actuation of any of the other push buttons, and withdrawal of that same "off" push button 19 is the condition precedent to being able to actuate any of the other push buttons. Thus, in FIG. 8, as well as FIGS. 5 and 6 to be discussed subsequently, withdrawal of the "off" push button 19 renders the lockout slider ineffective.

Figure 6:
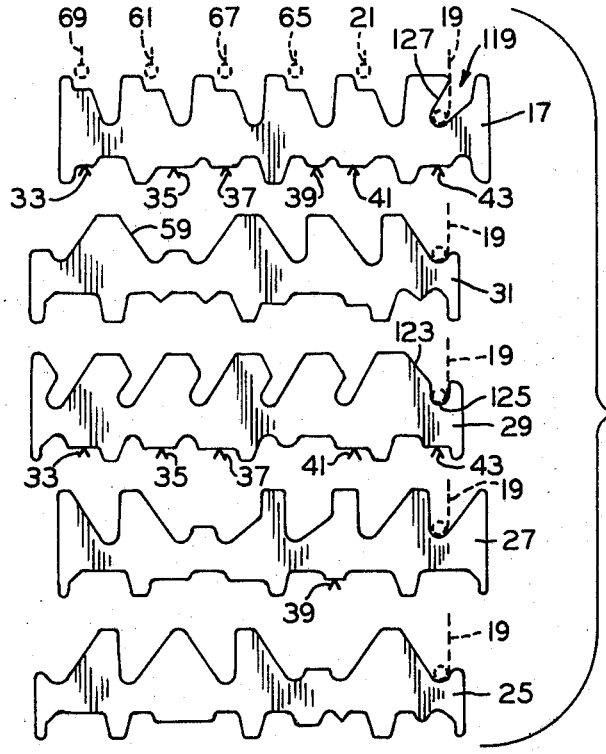
FIG. 6 is a schematic view of the set of sliders of FIG. 5 in the "off" position.

The slider sets of FIGS. 7 and 8 differ primarily in the lockout slider configuration. Lockout slider 15 is somewhat a mirror image of lockout slider 13 in that the lockout direction for lockout slider 13 is toward the left as illustrated, whereas the lockout direction for lockout slider 15 is toward the right as illustrated. This distinction is somewhat arbitrary and either slider could be redesigned in such a mirror image manner. Lockout slider 15 includes an additional blocking surface 109 which precludes the direct actuation of "warm" push button 21 since in the FIG. 8 configuration, "warm" push button 21 is not employed to render the lockout slider ineffective. Lockout slider 15 is shifted to its lockout position by the depression of "off" push button 19 engaging first a steeply inclined region 111 of a lockout actuating notch 113, and continued depression of "off" push button 19 engages this notch along a more gently inclined region 115 thereof forcing lockout slider 15 further toward the right as viewed until the actuating end of "off" push button 19 is nested near the bottom of notch 113 and lockout slider 15 is at its lockout position or maximum rightward travel. Extraction or withdrawal of "off" push button 19 engages notch 113 along a reversely inclined surface 117 thereof to urge lockout slider 15 toward the left and into its leftward or unlocked position. The force required to fully depress "off" push button 19 associated with the sliders of FIG. 8 may be somewhat irregular, requiring added force in the middle of the stroke to force lockout slider 15 to its right hand position, and it is believed that this irregularity of required applied force may be minimized by employing an irregularly contoured notch 119 of lockout slider 17, as depicted in FIGS. 5 and 6. In the slider system of these last two Figures, slider 121 has also been replaced by slider 29, which includes a helper surface 123 and a further lockout notch 125.

The sliders in FIG. 6 are relatively laterally displaced to the positions they would occupy when "off" push button 19 is depressed. That "off" push button has its actuating or interior end or end portion (a barrel-shaped rolled portion of the sheet metal button shank as illustrated) nested in notch 125, which notch has substantially vertical side walls so that any lateral force exerted on slider 29, for example by pressing strongly on another push button, will not result in transferring any force to dislodge "off" button 19 from that notch 125. With "off" button 19 in the position illustrated in FIG. 6, all of the switch blades are held off their respective fixed contacts by the cam surfaces along the lower edge of lockout slider 17. Additionally, each of these switch blades is held in its open position by at least one other cam surface associated with one of the other sliders in their respective illustrated positions. As "off" push button 19 is extracted or withdrawn in response to an operator applied force exerted thereon, it engages surface 127 of notch 119 in lockout slider 17 urging that slider 17 toward the left and into a position relative to the switch blades, as illustrated in FIG. 5, where slider 17 no longer holds the switch blades open. Further, lockout slider 17 now presents to the other five push buttons of switch 11 undercut portions or openings, such as 129, allowing actuation of those other five push buttons. With "off" push button 19 extracted, the "high" push button 69, for example, may be depressed to realign the sliders as illustrated in FIG. 5.

In FIG. 5, the repositioning of lockout slider 17 allows each of switch blades 33, 35, 37, 39, 41 and 43 to spring towards its respective fixed contact, however, as illustrated, switch blades 37 and 39 are held in their open position, for example due to the position of slider 27, engaging contact blade 37, along a cam surface 131, and engaging contact blade 39, along a cam surface 133. The other four switch blades are allowed to close in the FIG. 5 configuration, giving the "high" electrical connection depicted in FIG. 4. Any single other heating position push button could have been actuated, and such other push buttons may be depressed in any desired sequence to operate substantially as illustrated, for example in the above-mentioned Vermeulen patent. The delay feature or flashover protection aspect, illustrated in the Vermeulen patent, may be incorporated in the slider switch of the present invention and, for example, is illustrated by the more gently sloped inclined surfaces 135 and 137, which are actuated by "medium" heat switch button 67 and "low" heat switch button 65, respectively.

In returning to the "off" and therefore also a lockout state, "off" push button 19 is depressed, urging slider 31 toward the left, slider 27 toward the right, and slider 25 toward the left. Additionally "off" push button 19 engages slider 29 along inclined surface 123, urging slider 29 toward the left, and by way of inclined surface 139, reciprocally returning push button 69 to its out location. "Off" push button 19 also engages a slope 141 of notch 119, urging lockout slider 17 toward the right and into its lockout position.

With the lockout notch configured as in FIG. 8, the sloped surfaces, such as 143 of the lockout slider, are sometimes relied upon for raising a previously depressed push button; however, with this notch configured as illustrated on lockout slider 17 at 119, all of the work in raising a previously depressed push button is performed by slider 29 as it is actuated by the "off" push button engaging sloped surface 123, resulting in a somewhat more smooth operation of the "off" button.

Returning briefly to FIGS. 3 and 4, the incorporation of the push button switch of the present invention into an exemplary electric range burner control circuit will be easily understood. Adjacent fixed contacts, such as 47 and 49, are connected together to a terminal 149 and coupled to one side of a conventional 230 V alternating current source. Similarly, adjacent fixed contacts 51 and 53 are connected together to a terminal 145 which connects to the source voltage neutral line, and adjacent fixed contacts 55 and 57 are connected to a terminal 147 and then to the other side of the 230 V source. Thus, the voltage between terminals 145 and 147 is 115 V, while that between terminals 147 and 149 is 230 V. The two resistive heating elements of the burner are, for example, connected in series with the 115 V source when "warm" button 21 is depressed, placing the switch in its "warm" state. These two heating elements 151 and 153 would also be connected in parallel across the 230 V source when "high" heat button 69 is depressed. To achieve this interconnection, switch blade 43 is connected by way of a switch terminal 155 to one side of a heating element 153, while the other side of that heating element is connected to a terminal 157, which terminal is common to switch blades 35 and 37. Switch blades 39 and 41 have a common terminal 159 which is connected to one side of the other heating element 151, the first side of which is connected in common with heating element 153 to terminal 157. An additional terminal 161 provides a pilot light function indicating that the switch 11 is in other than the "off" state.

From the foregoing it is now apparent that a novel electrical switch 11 has been presented meeting the objects and advantageous features set out hereinbefore as well as others and that modifications as to the precise configurations, shapes, details and connections of such switch may be made by those having ordinary skill in the art without departing from the spirit of the invention or the scope thereof as set out by the claims which follow.

What I claim as new and desire to secure by Letters Patent of the United States is:

1. An electrical switch comprising a housing having a chamber therein, a plurality of terminals disposed in said housing and each of said terminals having a mounting section within said chamber and an electrical connection section extending exteriorly of said housing; a plurality of first contacts on said mounting sections of some of said terminals, respectively; a plurality of resilient, electrical conductive switch blades on said mounting sections of others of said terminals and operable generally between a pair of switching positions, respectively; a plurality of second contacts on said switch blades and movable therewith so as to make with the first contacts in one of the switching positions of the switch blades and to break from said first contacts in the other of the switching positions of said switch blades, respectively; a plurality of push buttons reciprocally movable in a pair of opposite directions in said housing and each of said push buttons including a pair of opposite end portions disposed within said chamber and exteriorly of said housing, respectively; a plurality of generally elongate sliders shiftably movable in said chamber and arranged therein generally in side-by-side relation with each other, each of said sliders including a pair of opposite edges, a plurality of cam surfaces in one of said opposite edges and arranged to effect the operation of at least respective ones of said switch blades between the switching positions thereof upon the shifting movement of said sliders in said chamber, and a plurality of inclined surfaces in the other of said opposite edges with at least some of said inclined surfaces arranged to be engaged by said opposite end portions of said push buttons within said chamber to effect the shifting movement of at least some of said sliders in said chamber in response to an operator applied force on said one opposite end portion of said exterior push buttons to effect the movement thereof in one of the opposite directions in said housing, respectively; and one of said sliders comprising a lockout slider shiftably movable toward one shifted position of a pair of shifted positions thereof in said chamber in response to the operator applied force movement in the one direction of a preselected one of said push buttons so as to engage said other opposite end portion thereof with one of said inclined surfaces of said lockout slider, and said lockout slider including a plurality of means disposed at least adjacent said opposite end portions of at least some of the other of said push buttons for precluding the operator applied force movement thereof in the one opposite direction when said lockout slider is in its one shifted position in said chamber.

2. An electrical switch as set forth in claim 1 wherein another one of the push buttons, other than said at least some other push buttons, comprises a releasing push button movable in the one direction in response to the operator applied force exerted on said one opposite end portion thereof to engage its other opposite end portion with another of said inclined surfaces of said lockout slider and shift said lockout slider to the other of the shifted positions thereof in the chamber thereby to displace said precluding means on said lockout slider away from said other opposite end portions of said at least some other push buttons.

3. An electrical switch as set forth in claim 1 wherein said inclined surface plurality in said other opposite edge of said lockout slider includes a mating inclined surface arranged with respect to said one inclined surface so as to be engaged by said opposite end portion of said preselected one push button in response to an operator applied force in the other of the opposite directions exerted on said one opposite end portion thereof and thereby effect the shifting movement of said lockout slider into the other of the shifted positions thereof in said chamber displacing said precluding means on said lockout slider away from said other opposite end portions of said at least some other push buttons.

4. An electrical switch as set forth in claim 1 wherein said precluding means comprise a plurality of locking surfaces.

5. An electrical switch comprising a housing, a plurality of elongated sliders assembled in said housing in side-by-side relation for reciprocating movement, one lengthwise edge of each of said sliders being undercut to form a plurality of cam surfaces, a plurality of movable contact blades engageable with said cam surfaces of said sliders, each of said blades being movable so as to make and break contact with an opposing switch contact of the switch, respectively, said slider having a plurality of inclined surfaces which cooperate with a plurality of push buttons that extend through a wall of said housing, respectively, said inclined surfaces being arranged on said sliders so that the depression of any of said buttons will act upon one or more of said sliders causing them to shift said cam surfaces thereof toward or away from at least some of said contact blades so as to change the circuit arrangement of the switch, said inclined surfaces extending in such directions that only one button may be fully depressed at any one time; a lockout slider combined with said sliders and responsive to the depression of a specified button so as to be shifted to a first position precluding direct depression of certain of the other buttons, said lockout slider being shiftable in response to actuation of a specified button other than one of said certain other buttons to a second position thereby to allow depression of said certain other buttons.

6. An electrical switch as set forth in claim 5 wherein said lockout slider includes a plurality of other cam surfaces arranged so as to hold said contact blades from closing on said switch contacts when said lockout slider is in the first position thereof.

7. An electrical switch as set forth in claim 5 wherein movement of said specified button from the depressed position thereof shifts said lockout slider to the second position thereof.

8. An electrical switch as set forth in claim 5 wherein depression of a further button distinct from said specified button and from said certain other buttons shifts said lockout slider from the first position to the second position thereof.

9. An electrical switch as set forth in claim 5 wherein said lockout slider includes at least one inclined surface which cooperates with said specified button so as to effect the shifting of said lockout slider to the first position thereof, and a plurality of blocking surfaces extending generally in the direction of slider movement, said blocking surfaces being juxtaposed with the said certain other buttons so as to preclude the direct depression thereof only when said lockout slider is in its first position.

10. An electrical switch adapted to control a plurality of circuits therethrough comprising a plurality of operator actuable push buttons reciprocally movable to effect the control of the circuits, said push buttons including an "off" push button operable generally upon the depression thereof to open all of the circuits, means responsive to the depression of said "off" push button for precluding direct depression of certain of the other of said push buttons, and means actuable by an operator for rendering ineffective said precluding means including one of said "off" push button and another of said push buttons.

11. An electrical switch as set forth in claim 10 including means for preventing simultaneous depression of more than one of said push buttons.

12. An electrical switch as set forth in claim 10 wherein said rendering means includes said "off" push button, manual movement of said "off" push button from its depressed position being required prior to depression of one of said certain other push buttons.

13. An electrical switch as set forth in claim 10 wherein said rendering means includes such another push button of said push button plurality distinct from said certain other push buttons and from said "off" push button, manual depression of said another push button being required prior to depression of one of said certain other push buttons.

14. An electrical switch as set forth in claim 10 wherein respective ones of said certain other push buttons may be depressed without actuating said rendering means so long as said "off" push button is not depressed.

15. An electrical switch having a plurality of circuits therethrough comprising a plurality of operator actuable push buttons depressable to control the circuits therethrough and including an "off" push button which is depressible to open all of the circuits; means responsive to the depression of said "off" push button for precluding direct depression of certain other ones of said push buttons distinct from the "off" push button; and means actuable as a condition precedent to the depression of one of said certain other push buttons when said "off" push button is depressed.

16. An electrical switch adapted to control a plurality of circuits therethrough comprising a plurality of push buttons depressable to effect the completion of the circuits and including an "off" push button which is depressible to open all of the circuits, a lockout slider responsive to the depression of a preselected one of the push buttons to shift to a first position so as to preclude direct depression of certain other of the push buttons, said lockout slider being shiftable in response to actuation of another push button other than said certain other push buttons to a second position allowing depression of said certain other push buttons, and said lockout slider having a lengthwise edge including cam surfaces which in the first position prevent closure of any of the circuits and in the second position free the circuits for selective closure by the selective depression of at least said certain other push buttons.

* * * * *